US007717059B2

(12) United States Patent
Wanthal et al.

(10) Patent No.: US 7,717,059 B2
(45) Date of Patent: May 18, 2010

(54) LIQUID ADHESIVE DISPENSING SYSTEM

(75) Inventors: Paul David Wanthal, Bartlett, IL (US); Mutombo J. Muvundamina, Minneapolis, MN (US); James Haruch, Naperville, IL (US)

(73) Assignees: Spraying Systems Co., Wheaton, IL (US); H.B. Fuller Company, St. Paul, MN (US)

( * ) Notice: Subject to any disclaimer, the term of this patent is extended or adjusted under 35 U.S.C. 154(b) by 1339 days.

(21) Appl. No.: 11/153,265

(22) Filed: Jun. 15, 2005

(65) Prior Publication Data

US 2006/0286290 A1 Dec. 21, 2006

(51) Int. Cl.
*B05C 11/10* (2006.01)

(52) U.S. Cl. ..... 118/669; 118/683; 118/684; 118/712; 118/713; 118/323

(58) Field of Classification Search ..... 118/712, 118/713, 320, 323, 321, 683, 684, 669
See application file for complete search history.

(56) References Cited

U.S. PATENT DOCUMENTS 4,263,166 A * 4/1981 Adams ..... 261/78.2
4,462,543 A * 7/1984 Yam ..... 239/8
4,779,762 A * 10/1988 Klein et al. ..... 222/52
6,136,422 A 10/2000 Lichtenberg et al.
6,296,706 B1 10/2001 Dattilo
6,635,134 B1 10/2003 Lichtenberg et al.
2003/0127536 A1* 7/2003 Donley et al. ..... 239/290
2004/0255852 A1* 12/2004 Briese et al. ..... 118/696

* cited by examiner

*Primary Examiner*—George R Koch, III
(74) *Attorney, Agent, or Firm*—Leydig, Voit & Mayer, Ltd.

(57) ABSTRACT

A liquid adhesive dispensing system operable for more uniformly applying liquid adhesive foam onto moving substrates, notwithstanding changes in line speed, adhesive liquid flow rates, or foaming/atomizing air pressures. The illustrated liquid adhesive system includes a header having a plurality of air atomizing spray guns; the spray guns each having a respective variable speed positive displacement pump for directing a metered quantity of liquid adhesive from a liquid adhesive supply to the respective spray gun; and a control for controlling the operating speed of the positive displacement pumps in relation to the speed of the moving substrate and the foaming/atomizing air pressure to the spray guns in relation to the operating speed of the positive displacement pumps. The control further is operable for monitoring pressures across the positive displacement pumps for insuring the accurate direction of metered quantities of liquid to the spray guns. The spray guns are adapted for enhanced liquid adhesive foaming and atomization, and the header is convertible into a closed housing structure effective for containing cleaning and purge liquids during an automatically operable cleaning cycle of operation.

38 Claims, 9 Drawing Sheets

11
20
25
12
Z
10
22
24
20
22
21
120

11
24b
24a
Z
20
12
120b
120a
25
21
122
22
24
124
120
124
129
121
AIR / WATER HEADER SYSTEM 124
120
20
122
124
12
21
22
24
129
121
DRAIN

LIQUID ADHESIVE DISPENSING SYSTEM

FIELD OF THE INVENTION

The present invention relates generally to the manufacture and processing of laminated sheet material, and more particularly, to a system for dispensing liquid adhesive onto a moving ply or sheet substrate in the manufacture of multi-ply laminant materials, such as bathroom tissue, facial tissue, napkins, paper towels, non-woven sheet material, and the like.

BACKGROUND OF THE INVENTION

Various techniques have been used and proposed for bonding layers of laminated sheet material. These techniques have included mechanically forcing the layers together to physically interlock the laminated layers, applying hot melt adhesives to the sheet material for adhesively bonding the laminated layers, and applying water-based adhesives to the sheets. The systems for carrying out these techniques have suffered various drawbacks, including necessitating equipment that was expensive in construction and difficult to maintain, creating mechanical or adhesive bondings of the laminated layers that were inconsistent or inadequate, being difficult to reliably control during changes in processing speeds and conditions, and resulting in over application, waste, slow drying, and bleed through of the applied liquid adhesives. Efforts to facilitate application of the liquid adhesives through pressurized air atomization of the liquid adhesive also have been the subject of problems which detract from the uniform or reliable application of the adhesive. Since atomizing air pressure can create a back pressure in the liquid adhesive supplied to a spray or dispensing nozzle, changes in the atomizing air pressure, such as during a processing change, can alter the flow rate of liquid through the spray nozzle. Hence, it has been difficult to accurately control processing parameters when modifying liquid adhesive and/or atomizing air pressures for different product requirements. Moreover, spraying adhesive with such atomization systems is relatively dirty and inefficient due to low transfer efficiency, blow off, misting, and build up of adhesive on the machinery components.

OBJECTS AND SUMMARY OF THE INVENTION

It is an object of the present invention to provide a liquid adhesive dispensing system for laminating sheet material that is adapted for more uniformly applying liquid adhesives notwithstanding changes in processing conditions.

Another object is to provide a liquid adhesive dispensing system as characterized above which is operable for generating a predetermined uniformly controlled, fine bubble foam of liquid adhesive prior to dispensing onto moving sheet material.

A further object is to provide a liquid adhesive dispensing system of the above kind in which pressurized air foaming and/or atomization of the liquid adhesive can be uniformly effected and controlled, notwithstanding changes in the line speed of the moving substrate material, changes in the liquid adhesive flow rate, or changes in atomizing air pressure.

Yet another object is to provide a liquid adhesive dispensing system of such type that permits selective control and changes in foam density and/or application rates as required during different sheet lamination processing.

Still another object is to provide such dispensing system that is effective for generating and applying a water based liquid adhesive in the manner that facilitates faster drying and minimizes damaging bleed through of the tissue substrate.

Another object is to provide a liquid adhesive dispensing system of the foregoing type which includes a plurality of liquid adhesive dispensing nozzles disposed across the width of a moving ply of sheet material for enabling selected patterns and/or concentrations of adhesive to be applied to the moving sheet material.

A further object is to provide such a liquid adhesive dispensing system that is adapted for relatively economical construction and easy maintenance. A related object is to provide such an adhesive dispensing system that enables automated cleaning of adhesive dispensing nozzles and associated liquid adhesive supply components.

Other objects and advantages of the invention will become apparent upon reading the following detailed description and upon reference to the drawings, in which:

Figures 1, 2, 3:
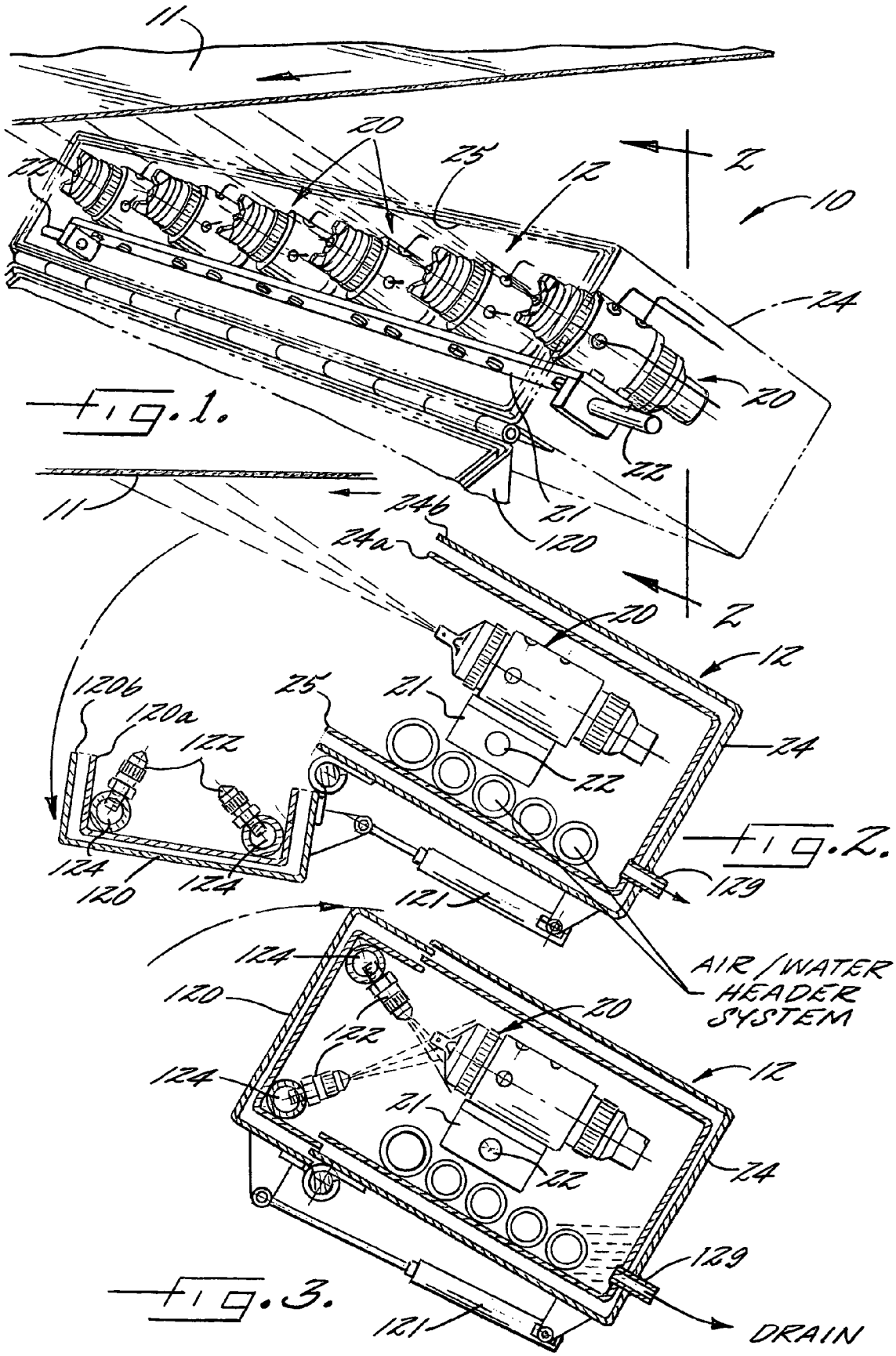
FIG. 1 is a perspective of a spray header of a liquid adhesive dispensing system in accordance with the invention shown directing a liquid adhesive foam onto a passing ply, such as a web of sheet material to be used in the manufacture of a laminated product.
FIG. 2 is a vertical section of the illustrated spray header taken in the plane of line 2-2 in FIG. 1.
FIG. 3 is a vertical section, similar to FIG. 2, but showing the spray header in a closed self-cleaning condition.
Figure 4:
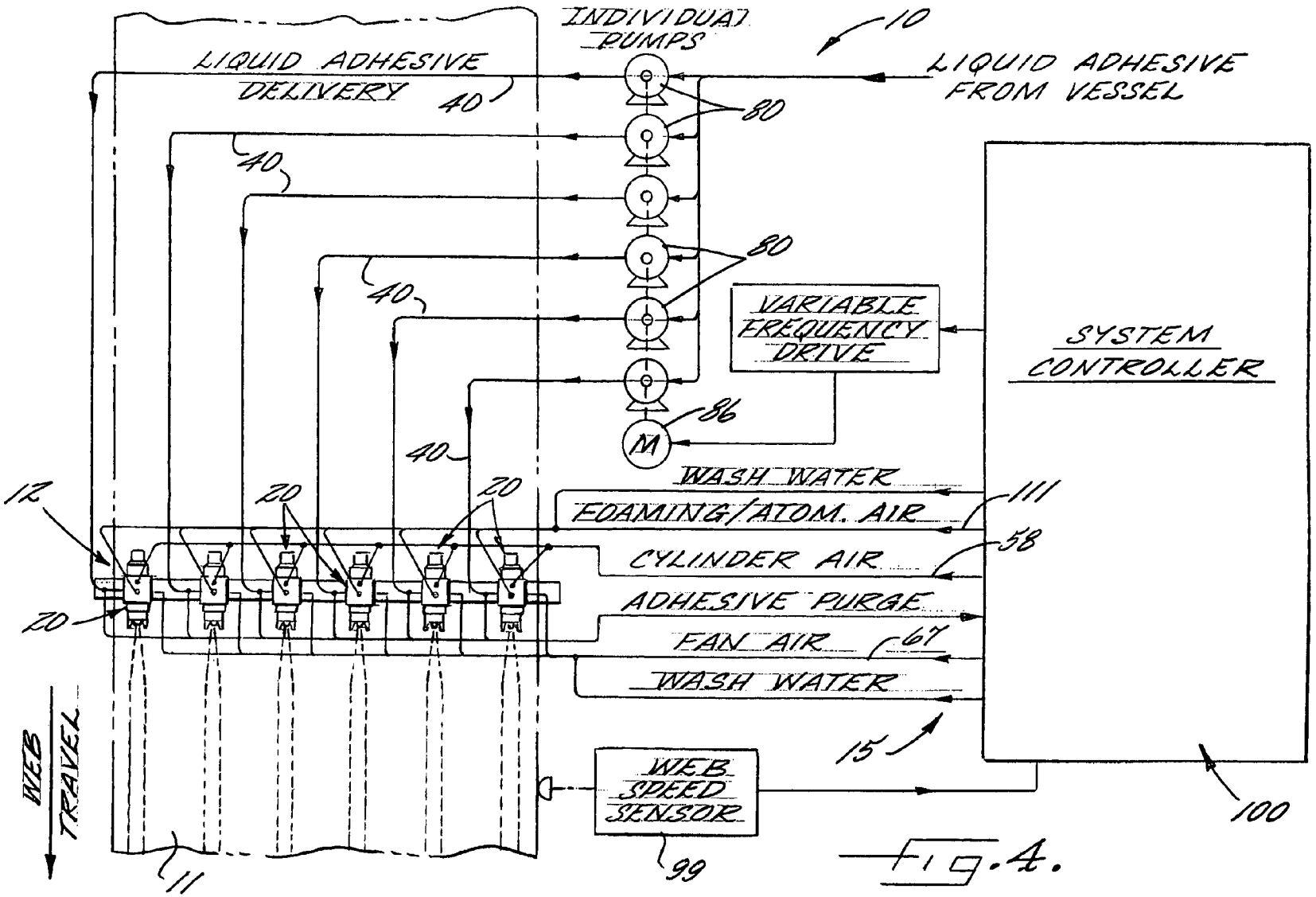
FIG. 4 is a schematic of a liquid adhesive dispensing system according to the invention utilizing a spray header such as shown in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF PREFERRED EMBODIMENT

Referring now more particularly to the drawings, there is shown an illustrative liquid adhesive dispensing system 10 in accordance with the invention operable for directing water based liquid adhesive onto a moving ply or sheet substrate 11, such as in the manufacture of laminated sheet materials, including bathroom tissue, facial tissue, napkins, paper towels and the like. The illustrated adhesive dispensing system 10 basically includes a spray header 12 (FIGS. 1-6), a liquid adhesive supply 14 (FIGS. 7 and 11), and a liquid adhesive delivery control system 15 (FIGS. 7, 11 and 12) for controlling the delivery of liquid adhesive from the liquid supply 14 to the spray header 12. It will be understood by one skilled in the art that following the dispensing of adhesive onto the moving substrate 11, the substrate can be joined to another moving ply in a known manner to form a multiple ply laminate. Moreover, while the invention has particular utility for dispensing water based adhesives in the manufacture of laminated products, it will be understood that the liquid dispensing system 10 can be used for dispensing other types of liquids in other applications.

The spray header 12 in this case includes a plurality of spray guns or nozzle assemblies 20 disposed in transversely spaced relation across the width of the moving substrate 11. The spray guns 20 are supported on a common cross beam 21, which in turn is supported at opposite ends by rods 22. The spray guns 20 each are bolted onto the crossbeam 21 in parallel relation to each other, and the support rods 22 preferably are mounted for selective pivotal movement for enabling the desired direction of discharging adhesives from the guns in predetermined angular relation to the moving substrate. The illustrated spray header 12 has a rectangular longitudinally extending enclosure or housing 24 mounted in surrounding relation to the spray guns 20, with the housing 24 having an open end 25 from which adhesive is discharged from the spray guns 20. As depicted in FIG. 2, and as will become apparent, fluid supply lines for the spray guns 20 extend along and are protectively contained within the housing 24. It will be understood that the number of spray guns may vary depending upon a particular spray application.

Figures 5, 5A:
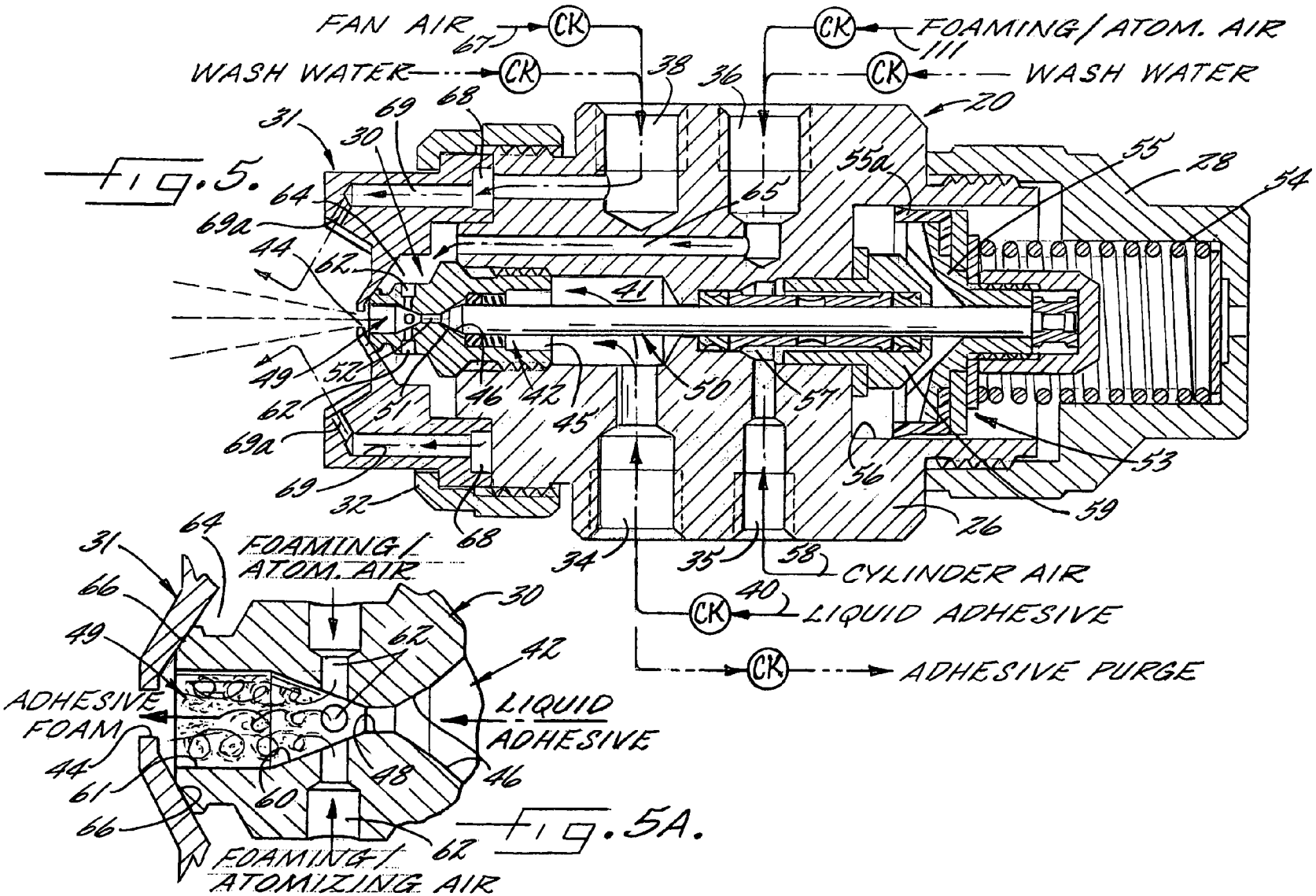
FIG. 5 is an enlarged vertical section of one of the liquid adhesive dispensing guns of the illustrated header.
FIG. 5A is an enlarged fragmentary section of a nozzle insert included in the adhesive dispensing gun shown in FIG. 5.
Figure 6:
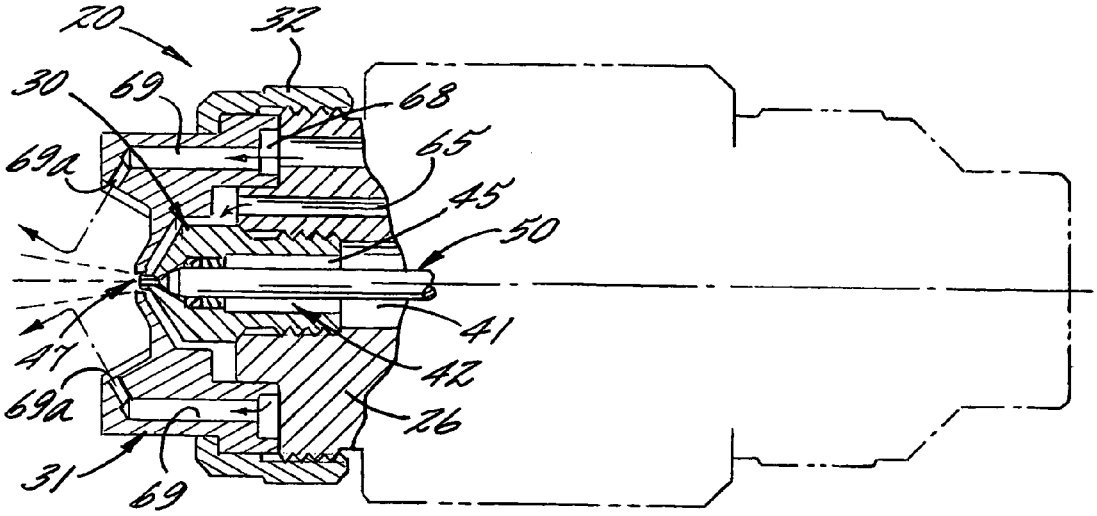
FIG. 6 is a fragmentary section of an alternative embodiment of spray gun for use in the liquid dispensing system of the present invention.
Figures 7, 7A:
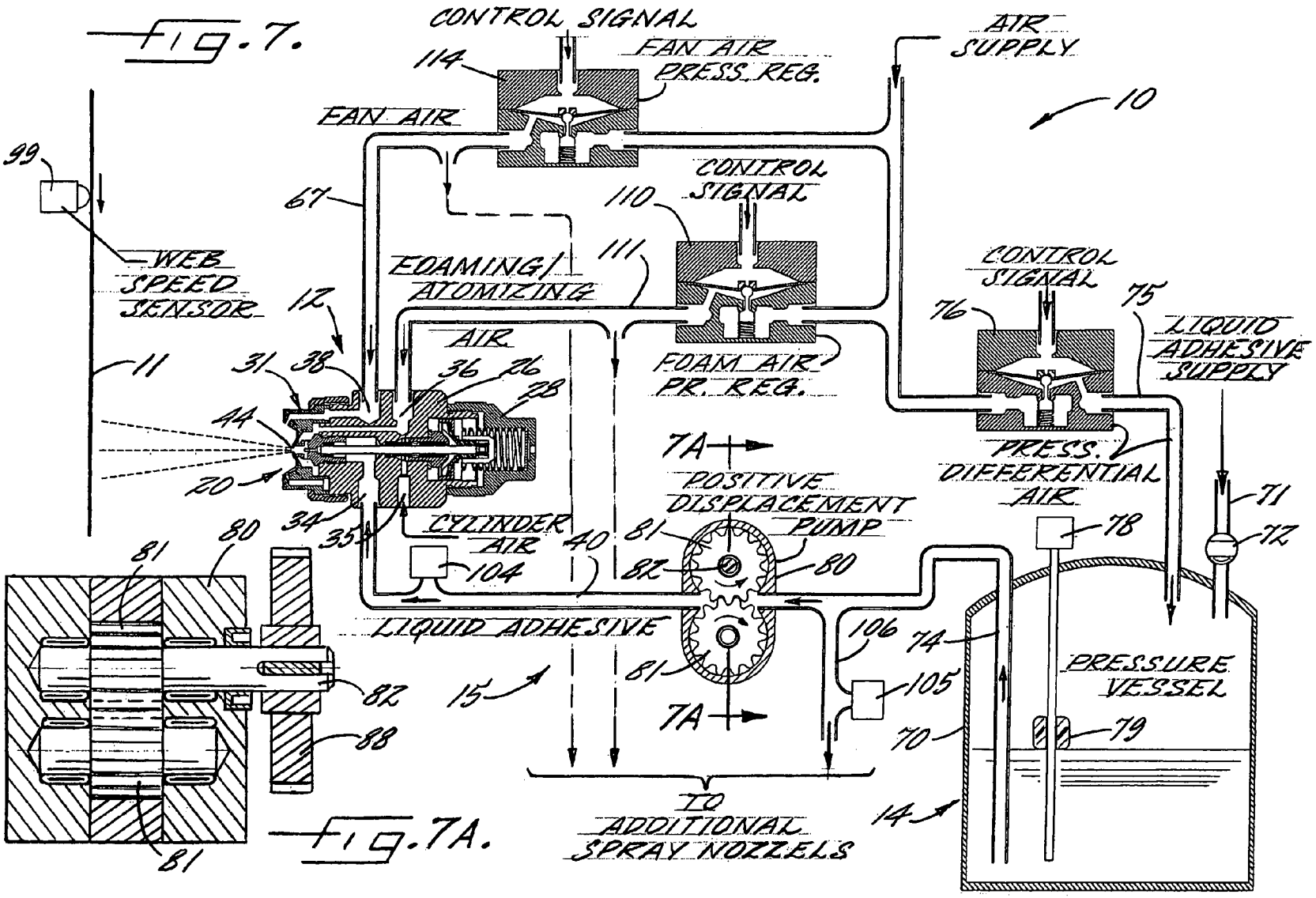
FIG. 7 is a diagrammatic depiction particularly showing of the liquid adhesive delivery control system for the illustrated dispensing system.
FIG. 7A is an enlarged fragmentary section of one of the positive displacement pumps, taken in the plane of line 7A in FIG. 7.

In carrying out one aspect of the invention, the spray guns 20 each comprise internal mix air atomizing spray nozzle adapted for generating a fine adhesive foam within the nozzle which can be dispensed in a controlled manner over a predetermined lateral segment or zone of the moving substrate. The illustrated spray guns 20, as depicted in FIG. 5, each include a main body or housing 26, a rear housing cap 28 threadedly engageable with the body 26, a nozzle 30 threadedly engaged in a downstream end of the body 26, and an air cap 31 mounted in overlying surrounding relation to the nozzle 30 and retained on the main housing body 26 by a retaining nut 32. The nozzle body 26 has a liquid adhesive inlet port 34, a cylinder air inlet port 35, a foaming/atomizing air inlet port 36, and a fan air inlet port 38. Liquid adhesive supplied to the inlet port 34 from an appropriate supply line 40 (FIGS. 4, 7 and 11) communicates with a central longitudinal passageway 41 in the nozzle 30, and in turn, with a liquid flow passage 42 in the nozzle 30 prior to discharge through a foam discharge orifice 44 in the air cap 31 (FIGS. 5 and 6). The nozzle flow passageway 42 in this case is defined by an upstream cylindrical inlet section 45, a tapered entry and valve seating section 46, a small diameter nozzling section 48, and a downstream, large diameter, mixing chamber 49 (FIGS. 5 and 6).

For controlling the discharge of liquid adhesive from the spray gun 20, a valve needle 50 coaxially extends through the housing body 26 for reciprocating movement between a valve closing position in seated engagement with the tapered entry section 46 of the nozzle passage 42 and unseated valve open position. The valve needle 50 in this case has a tapered seating section, preferably formed by two conical sections which define a sealing edge 51 engageable with the tapered entry section 46 of the nozzle 30, and an axially extending clean out nose portion 52 that is positionable into the nozzling section 48 of the valve passage 42 when in a closed position for maintaining the passage free of adhesive buildup during usage.

For operating the valve needle 15, as is known in the art and disclosed in more detail in U.S. Pat. No. 6,776,360 assigned to Spraying Systems Company, one of the co-assignees of the present application, the disclosure of which is incorporated herein by reference, the valve needle 50 has a piston assembly 53 at an upstream end which is biased in a valve closing direction by a compression spring 54 interposed between the piston assembly 53 and the upstream housing cap 28. The piston assembly 53 includes a piston head portion 55 and a resilient annular cup shaped sealing ring 55*a* in sealing engagement with a cylindrical bore 56 in the housing body 26. The compression spring 54 biases the piston assembly 53, and hence the valve needle 50, forwardly to a fully seated, i.e., valve closed position, depicted in FIG. 5. The valve needle 50 is movable axially in the opposite direction (to the right in FIG. 5) against the force of the spring 54 by pressurized air (hereinafter "cylinder air") selectively directed into the cylinder air inlet port 35 from the pressurized air supply line 58 (FIGS. 4, 11, 12) which communicates through the housing body 26 with an air chamber 57 on the downstream side of the piston assembly 53.

In carrying out the invention, the nozzle mixing chamber 49 is designed for enhancing atomization and foaming of the adhesive liquid within the spray gun for generating a fine bubble foam that can be discharged onto the moving substrate 11 in a controlled fashion for effective adhesion of laminated plies of sheet material without undesirable bleed through in the substrate. To this end, the mixing chamber 49 of the nozzle 30 includes an outwardly tapered pressurized air interacting section 60 that communicates between the nozzling section 48 and a downstream cylindrical expansion chamber 61 (FIG. 5A). For directing pressurized air into the tapered air interaction section 60, the nozzle 30 is formed with a plurality of radial air passageways 62 communicating through the tapered side wall surface of the air interacting section 60 at a location adjacent the downstream end of the nozzling passage section 48.

The radial air passages 62, which in this case are disposed at 90° circumferential spacing to each other, communicate with an annular air chamber 64 defined between the nozzle 30 and the air cap 31, which in turn communicates with the foaming/atomizing air inlet port 36 through a passageway 65 in the nozzle body 26. The nozzle 30 and air cap 31 have tapered surfaces 66 in contacting relation to each other about the air cap foam discharge orifice 44, and to facilitate an air tight connection, a suitable O-ring may be provided on an inner side of that juncture. The nozzle expansion chamber 61 preferably has a diameter of at least three times the diameter of the nozzling passage section 48 and at least twice the diameter of the air cap foam discharge orifice 44. More preferably, the expansion chamber 61 has a diameter about five times the diameter of the nozzling passage section 48, and the air cap foam discharge orifice 44 has a diameter of about twice the diameter of the nozzling passage section 48. While the theory of operation is not completely understood, it is believed that intersection of the air inlet passages 62 with the tapered air interaction section 60 of the nozzle 30 creates a relatively large orifice area in close proximity to the nozzling section 48 such that liquid entering the interaction section 60 cannot escape the effect of the incoming pressurized air streams, such as by closely following wall surfaces of the liquid flow passage 42. Hence, it has been found that when liquid adhesive is directed through the nozzle 30 the plurality of circumferentially spaced radial atomizing air streams directed into the tapered air interacting section 60 effect thorough agitation, atomization, and fine bubble foamation of the adhesive, which thereupon expands into the expansion chamber 61 prior to further atomization of the foam by the pressurized air as foam is emitted from the discharges through the relatively smaller diameter air cap foam discharge orifice 44.

For forming and directing the foam into a flat fan spray pattern for wider lateral application onto the moving substrate 11, each spray gun 20 is operable for impinging pressurized air (i.e., "fan air") on opposite sides of the foam following discharge from the air cap discharge orifice 44. In the illustrated embodiment, pressurized air is communicated to the fan air inlet port 38 of the spray gun from a pressurized air supply line 67 (FIGS. 4, 11, 12), which in turn communicates through the nozzle body 26 with an annular chamber 68 defined between axial ends of the nozzle body 26 and air cap 31. The annular chamber 68 communicates pressurized air to a pair of longitudinal passages 69, which terminate in opposed angled discharge passages 69*a* (FIG. 5) that direct pressurized air streams at an acute angle on opposite sides of the discharging liquid adhesive foam for spreading the foam into a relatively flat narrow spray pattern transverse to the direction of movement of the substrate upon which it is directed. It will be appreciated that the width of the flat spray fan spray, and hence the width of the application zone on the substrate can be controlled by the fan air pressure.

Figure 6A:
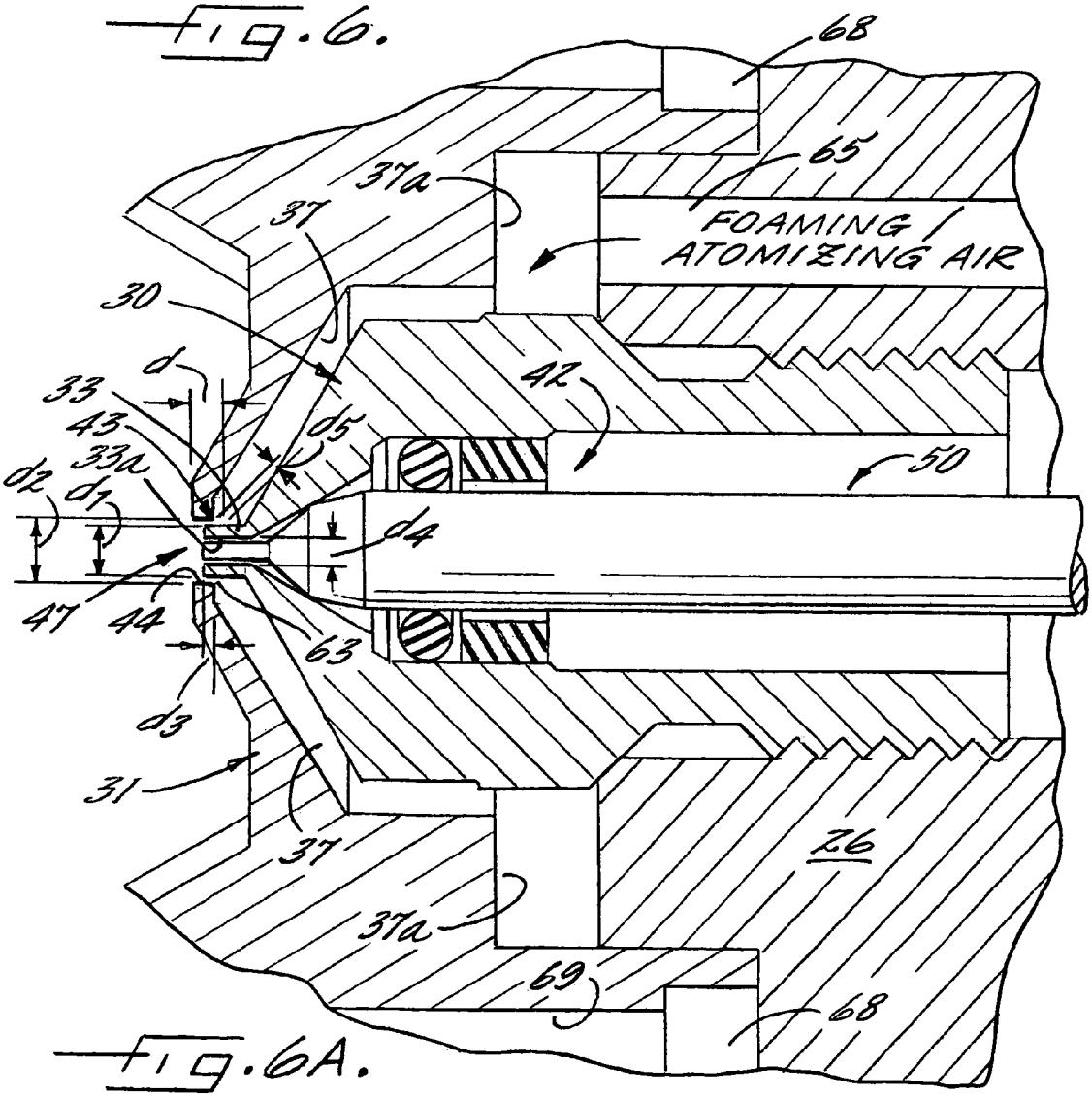
FIG. 6A is an enlarged fragmentary section of the spray nozzle of the spray gun shown in FIG. 6.

Referring to FIGS. 6 and 6A, there is shown an alternative embodiment of a spray gun that can be used in the illustrated liquid adhesive dispensing system, wherein items similar to those described above have been given similar reference numerals. The spray gun in this case has an alternative form of spray nozzle design which utilizes a combination internal/external air atomization technique in generating and atomizing fine bubble liquid adhesive foam. The spray gun 20 again comprises a housing body 26, a nozzle 30 threadedly engaging a discharge into the body 26, and an air cap 31 disposed in surrounding relation to the nozzle 30 and retained on the housing body 26 by a retaining nut 32. The nozzle 30 in this case has a relatively small diameter forwardly extending nose portion 33 which defines a liquid discharge orifice 33*a* in coaxial relation to the air cap foam discharge orifice 44. The nozzle 30 and air cap 31 in this instance define foaming/atomizing air passages 37 communicating between an annular air supply chamber 37*a*, which in turn communicates with the foaming/atomizing air supply passage 65.

In carrying out the invention, the nozzle nose portion 33 is disposed in recessed relation to the air cap discharge orifice 44 for defining a liquid adhesive mixing and atomizing chamber 43 immediately downstream of the nozzle discharge orifice 33*a* adapted for effectively foaming and atomizing the liquid adhesive flow stream both prior to and as an incident to discharge from the spray gun. To this end, in the illustrated embodiment, the downstream end of the nozzle nose portion 33 is recessed a distance d from the downstream side of the central air cap orifice 44 for defining a mixing chamber 47 immediately about the downstream end of the nozzle nose portion 33. The nozzle nose portion 33 preferably has an outer diameter d1 slightly less than the diameter d2 of the air cap discharge orifice 44, and the downstream end of the nose portion 33 extends a relatively small distance d3 into the air cap orifice 44. The downstream end of the nozzle nose portion defines a sharp annular corner, which together with a sharp annular corner defined by an inside edge of the air cap orifice 44, defines an angled passageway 63 communicating with the mixing chamber 47.

In practice, it has been unexpectedly found that the angled passage 63 defined between the sharp corners of the nozzle nose portion 33 and air cap discharge orifice 44 create eddy currents and turbulence in the pressurized air directed into the mixing chamber 47, which enhances foaming and atomization of the liquid adhesive within the mixing chamber 47 prior to the discharge from the spray gun. The turbulence further has been found to more effectively maintain the discharge orifices 33*a*, 44 of the nozzle and air cap free of significant buildup which could impede efficient performance. The recessed distance d of the nozzle nose portion 33 from the downstream side of the air cap discharge orifice 44 preferably is less than the diameter "d4" of the nose portion liquid discharge orifice 33*a*. In practice, good operating results have been obtained when the diameter d4 of the liquid discharge orifice 33*a* is 0.025 inches, the recessed distance d of the nozzle nose portion from the air cap end face is 0.013 inches, the distance d1 is 0.05 inches, the distance d2 is 0.067 inches, the distance d3 is 0.001 inches, and the distance d5 is 0.008 inches.

The liquid adhesive supply 14 in this case includes a closed pressure vessel 70 (FIGS. 7 and 11) into which liquid adhesive is pumped from an appropriate supply source through inlet supply line 71 having a control valve 72, and exits through a delivery line 74 communicating from near the bottom of the pressure vessel 70. The vessel 70 is pressurized by a pressurized air supply line 75 communicating with the pressurized air source under the control of a pressure regulator 76.

For automatically maintaining a level of liquid adhesive in the illustrated pressure vessel 70, a level sensor 78 of a known type is provided which includes a level monitoring float 79. When the liquid adhesive level is lowered to a predetermined level, the fill control valve 72 can be actuated in response to a signal from the sensor 78 to cause additional liquid to be pumped into the vessel 70. When the liquid adhesive reaches a predetermined upward level, the level sensor 78 will cause closure of the valve 72.

A wide variety of liquid adhesives may be used with the adhesive dispensing system of the present invention, including the water based liquid adhesives disclosed in U.S. application Ser. No. 10/654,335 filed Sep. 5, 2003, assigned to the H.B. Fuller Company, one of the co-assignees of the present invention, the disclosure of which is incorporated herein by reference. Representative aqueous adhesive compositions may include one or more monomeric, oligomeric and/or polymeric components, dispersed, suspended, emulsified, dissolved, or the like, in an aqueous medium. The adhesive composition may include at least one resin that is water-soluble or water-dispersible at a temperature in the range of from about 20° C. to about 90° C. A wide variety of different resin(s) and/or monomer ingredients thereof may be used. Representative examples of suitable resin types include one or more of acrylic, styrene-acrylic, styrene-butadiene, vinyl acetate, polyvinyl alcohol, urethane, chloroprene, phenolic, polyamide, polyether, polyester, polysaccharides (including starch, dextrin, cellulose, gums, or the like), combinations of these, and the like. Particularly useful resin(s) are acrylic, vinyl acetate, polyvinyl alcohol, dextrin, starch, and the like. The composition may be supplied as a solution, latex, emulsion, dispersion, or the like. In addition to the resins and monomer ingredients, the adhesive compositions may include lubricants, emollients, rheology modifying agents, antimisting additives, fillers, extenders, foaming agents, or the like.

Examples of adhesive compositions include the following:

1. One part of Laponite RDS is dispersed in water for 20 minutes; 20 parts of a low-molecular polyvinyl alcohol resin (Celvol 205) is added and blended until a smooth mixture is obtained. Then the blend is heated to 190-200° F. for 30 minutes under a gentile agitation. The solution is then cooled to 100-120 and a biocide is added and the viscosity adjusted between 250-300 cP at room temperature (72 F). The resulting composition can be used in the illustrated dispensing system to produce a foam of fine beads or bubbles for effectively bonding layers of multiple ply tissue and the like.
2. A product obtained from the polymerization of vinyl acetate monomer (30 parts) in an aqueous solution of dextrin (40 parts dextrin and 30 parts water) is diluted to a viscosity range of 250 to 300 cP at 72 F, to yield a solution containing about 50% solids. A diluted solution can then be generated into a fine bubble foam by the illustrated dispensing system for effectively bonding laminated sheet material.

Heretofore as indicated above, it has been not only difficult to generate suitable finely atomized foam from liquid adhesives, but even more difficult to control the uniform application of the foam onto a moving substrate during start-up operations in which the movement of a substrate is accelerating and during changes in processing conditions. Moreover, when pressurized air atomization has been used to assist in atomization and foaming of the adhesive, changes in air atomizing pressure create changes in back pressure to the liquid supply which can impede the liquid supply, affect the desired density and makeup of the foam, and hinder reliable processing control.

In accordance with an important aspect of the invention, the liquid adhesive delivery control system 15 is operable for generating and dispensing foam with desired properties during a full range of operation of the dispensing machine, as well as during machine start up and changes in processing parameters, including changes in liquid and/or air atomizing pressures. To this end, the liquid dispensing system includes a plurality of positive displacement pumps 80 which each are dedicated to a respective one of the spray guns 20 for directing predetermined metered quantities of liquid to the spray guns 20 for consistent and uniform application onto a moving substrate 11, notwithstanding changes in processing speeds or conditions. The illustrated positive displacement pumps 80 are gear-type pumps which each comprise a pair of intermeshing gears 81, one of which is power driven from a drive shaft 82. (FIGS. 7 and 7A) As is known in the art, as one of the gears 81 is driven, the two gears rotate and mesh to force a specific quantity of liquid from the inlet to the outlet side of the pump 80 in a positive manner during each revolution of the gears. Such positive displacement gear pumps are commercially available, such as Brown & Sharp Model 700 Series gear pumps offered by BSM Pump Corporation, North Kingstown, R.I. It has been found that such positive displacement pumps 80 effectively act as a liquid metering device for each spray gun 20 such that the supply of liquid adhesive to the spray guns 20 can be precisely controlled and changed through control of the operating speed of the pumps 80. It will be understood that while gear pumps are disclosed in the illustrated embodiment, other types of positive displacement pumps may be used in the liquid adhesive delivery system, such as progressive cavity displacement pumps of a known type.

Figure 8:
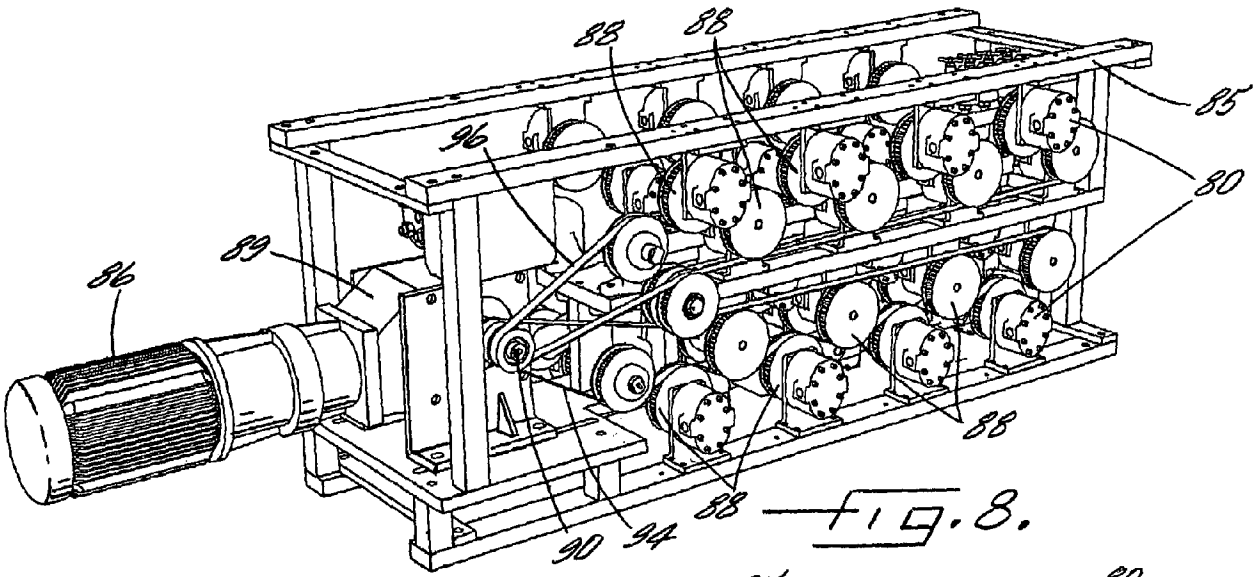
FIG. 8 is a perspective of a pumping apparatus used in the illustrated liquid adhesive delivery control system for directing liquid adhesive from a liquid adhesive supply to the spray header.
Figure 9:
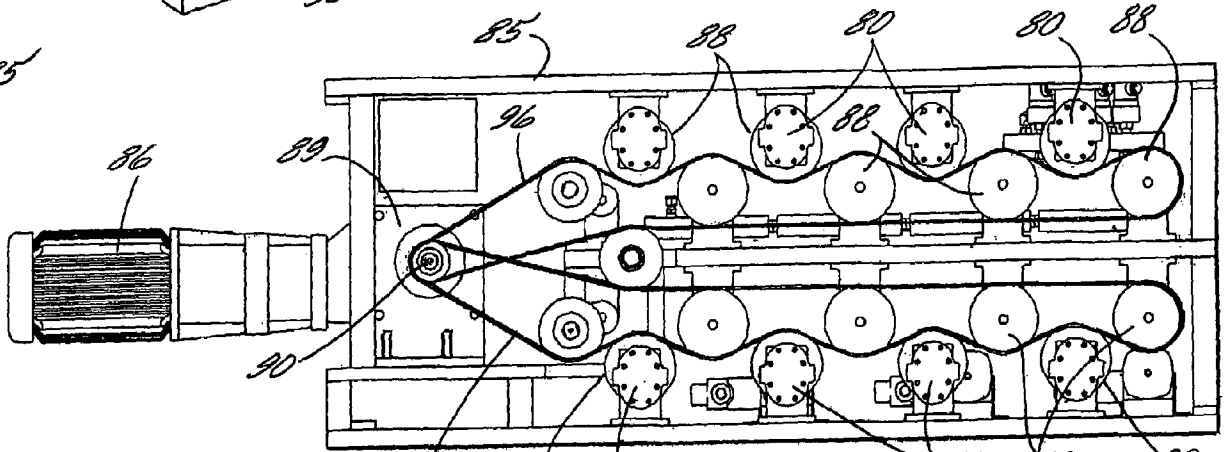
FIGS. 9 and 10 are side elevational and end views, respectfully, of the pumping apparatus shown in FIG. 8.
Figure 10:
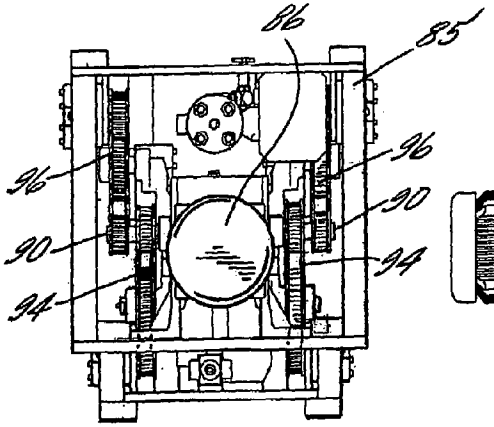

In carrying out the invention, the positive displacement pumps 80 in the illustrated embodiment are driven from a common power source such that the pumps 80 uniformly deliver similar quantities of liquid adhesive to the respective spray guns 20. In the illustrated embodiment, as depicted in FIGS. 8-10, the pumps are mounted on a frame 85 and are driven by a common drive motor 86, such as a selectively controllable variable frequency drive motor of a conventional type. The illustrated frame 85 has a rectangular construction which supports a first plurality of pumps 80 in a first row along a bottom of the frame 85 and a second plurality of pumps 80 in a second row along a top of the frame 85. The drive shafts 82 of each pump 80 carry a respective drive sprocket 88, and the drive motor 86 in this case has a gear box 89 with an output drive shaft 90 that carries a pair of drive sprockets. One of the drive motor sprockets is operatively coupled to and drives the first row of pumps 80 via a first endless belt or chain 94 trained about the drive sprockets 88 for the pumps 80 in the first row and drive sprockets 95. The other drive motor sprocket is coupled to and drives the pumps 80 of the second row via a belt or chain 96 trained about the drive sprockets 88 for the pumps 80 of the second row and drive sprockets 98. Hence, selected operation of the drive motor 86 will simultaneously operate the positive displacement pumps 80 of both rows, causing the pumps 80 to direct substantially similar quantities of adhesive to the respective spray guns 20 based upon the operating speed of the pumps 80. Although the common drive for the multiplicity of positive displacement pumps 80 provides economy in design and manufacture of the dispensing system, alternatively it will be understood that individual drive motors could be used to permit independent flow control for each spray gun.

In further carrying out this aspect of the invention, the liquid delivery control system 15 is operable for controlling the speed of the positive displacement pumps, and hence the quantity of adhesive liquid directed to the spray guns 20, proportional to the speed of the moving substrate 11 such that a constant quantity of adhesive may be applied to the substrate within a full range of operating web speeds. For this purpose, the delivery control system 15 includes a tachometer 99 of a known type for sensing the speed of the moving substrate 11 and a main controller 100 for the dispensing system responsive to signals from the tachometer 99 for proportionally controlling the operating speed of the positive displacement pumps 80. Hence, it can be seen that the desired adhesive application rate can be set in the controller either prior to or during operation, and the delivery control system 15 will automatically compensate for changes in line speed by adjusting the operating speed of the pumps 80. Hence, a preprogrammed foam application rate can be set in the controller 100 and the system will automatically begin spraying at the programmed rate. During ramp-up, this rate will be maintained up through the maximum operating speed without further operator intervention. Moreover, since the positive displacement pumps 80 effectively meter the liquid delivery, the application rate is unaffected by other changes in processing parameters, including changes in atomizing air pressure, as will become apparent.

While the positive displacement pumps 80, and particularly the illustrated gear pumps, function as an effective liquid metering devices, it has been found that a high differential pressure build-up across the pumps can result in liquid being forced under pressure through the pumps by virtue of manufacturing tolerances between the gears and the pump housings. This phenomena, sometimes referred to as liquid slippage, can augment the throughput affected by rotary operation of the gears and alter uniformity of the generated foam.

Figure 11:
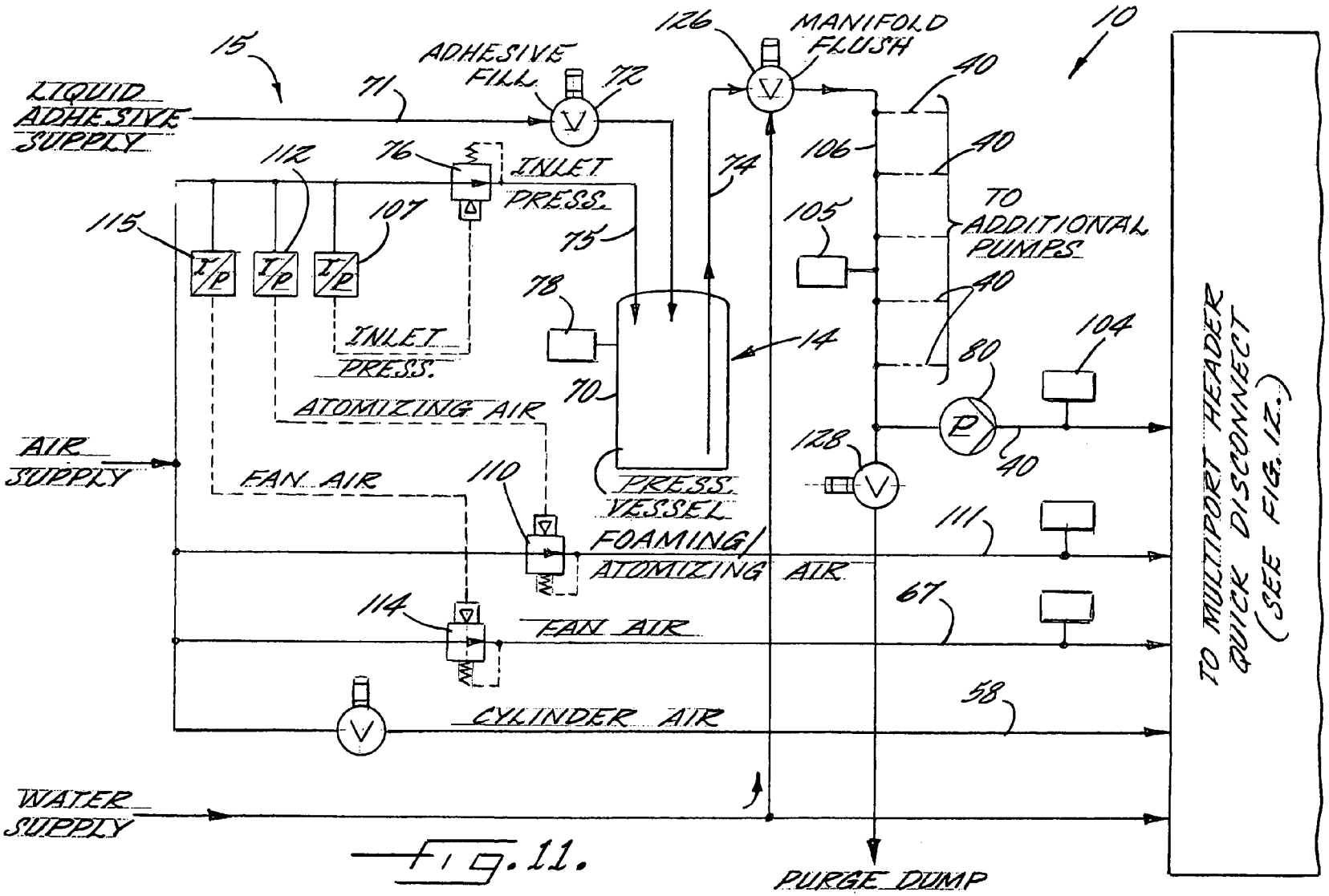
FIGS. 11 and 12 are more detailed schematics of the liquid direction control system for the illustrated dispensing system.

In carrying out the invention, in order to prevent liquid slippage through the pumps 80 and enhance reliable control in the delivery of liquid adhesive to the spray guns 20, the delivery control system 15 is operable for balancing the inlet and outlet pressures for each of the positive displacement pumps 80 to prevent pressure induced liquid slippage through the pumps. For this purpose, in the illustrated embodiment, a nozzle pressure transmitter 104 is provided in the outlet line 40 of each pump 80 (in this case the inlet line 40 to each spray gun 20) and a manifold pressure transmitter 105 is provided in a manifold supply line 106 that feeds the inlets to each of the pumps 80 (FIG. 11). In a typical operation of the dispensing system, for a programmed operating speed for the pumps 80, the nozzle pressure transmitter 104 will sense a pressure in the outlet line commiserate with the programmed flow rate. When the manifold pressure transmitter 105 senses a different pressure, the air regulator 76 to the liquid supply pressure vessel 70 is operated by pneumatic pilot signal from an I/P converter 107 under the control of the controller 100 to adjust the pressure in the pressure vessel 70, and hence, the liquid pressure in the manifold line 106 to equalize the inlet and outlet pressures across the pumps 80.

In keeping with still a further feature of the invention, the foaming/atomizing air and fan air to the spray guns 20 also can be selectively controlled for generating and applying foam with the desired characteristics. For controlling foaming/atomizing air, a foaming/atomizing air regulator 110 is provided in a foaming/atomizing air manifold line 111 that communicates with each of the spray guns 20 and which can be controlled by an I/P converter 112 via the controller 100. Fan air is communicated to each of the spray guns 20 via the fan air supply line 67, the pressure of which is controlled by a fan air regulator 114 via an I/P converter 115. Preferably through programming of the controller 100, uniform density of the foam can be achieved by automatically increasing foaming/atomizing air pressure proportionate to the operating speed of the positive displacement pumps 80. Alternatively, both foaming/atomizing air and fan air can be selectively controlled by the controller 100 independently of the liquid adhesive flow rates for a particular application. This can be particularly desirable when there is a need to increase the concentration of the adhesive, such as at the beginning or ending of a roll strip. This can be effected by reducing the foaming/atomizing air pressure, which will reduce atomization and permit the application of a more concentrated liquid adhesive. Likewise, reducing fan air pressure will result in a narrower, more concentrated, adhesive application.

From the foregoing, it can be seen that the liquid adhesive delivery control system 15 is effective for enabling precise control of both the adhesive delivery rate and the foam characteristics over a wide range of operating line speeds. In a typical operation of the liquid dispensing system 10, the substrate 11 can be moved at line speeds of up to 2,500 feet per minute with constant foam characteristics and uniform adhesive application rates. The adhesive application rates can vary between about 15 and 200 mg/ft$^2$ depending upon the desired bond strength. The foaming/atomizing air pressure preferably may be between 10-20 psi, with fan air pressures of 10 psi or less. The spray guns may be located between 6-12 inches from the moving web and dispense foam with transverse widths of about 5 to 6 inches. The foaming/atomizing air generates an adhesive foam within the nozzles, as described above, which is further atomized as the pressurized discharge emits from the nozzles. The fine bubble foamation of the adhesive and its atomized discharge substantially eliminates bleed through in even highly porous substrate tissue materials. The foam may have average bubble sizes of 100 microns or less, depending on the particular application and drying requirements. By appropriate control of the fan air, the system is operable for applying adhesive in either strips or 100% coverage. Tissue ply strength and other characteristics of the tissue, such as hand feel, smoothness, cushion, drape, emboss definition, bulk, absorbency, color, also are maintained.

In accordance with still a further feature of the invention, an automatically operable cleaning system is provided for cleaning the both exterior and interior surfaces of the spray guns 20. In the illustrated embodiment, the spray header housing 24 has a cover 120 which is normally disposed in an open position, as depicted in FIG. 2, during adhesive dispensing operations. To initiate a cleaning operation, the controller 100 can be programmed to actuate an air cylinder 121 which causes the cover 120 to pivot to a closed position, as depicted in FIG. 3, enclosing the spray guns 20 within the housing 24 so that all sprays and purge water are captured.

Figure 12:
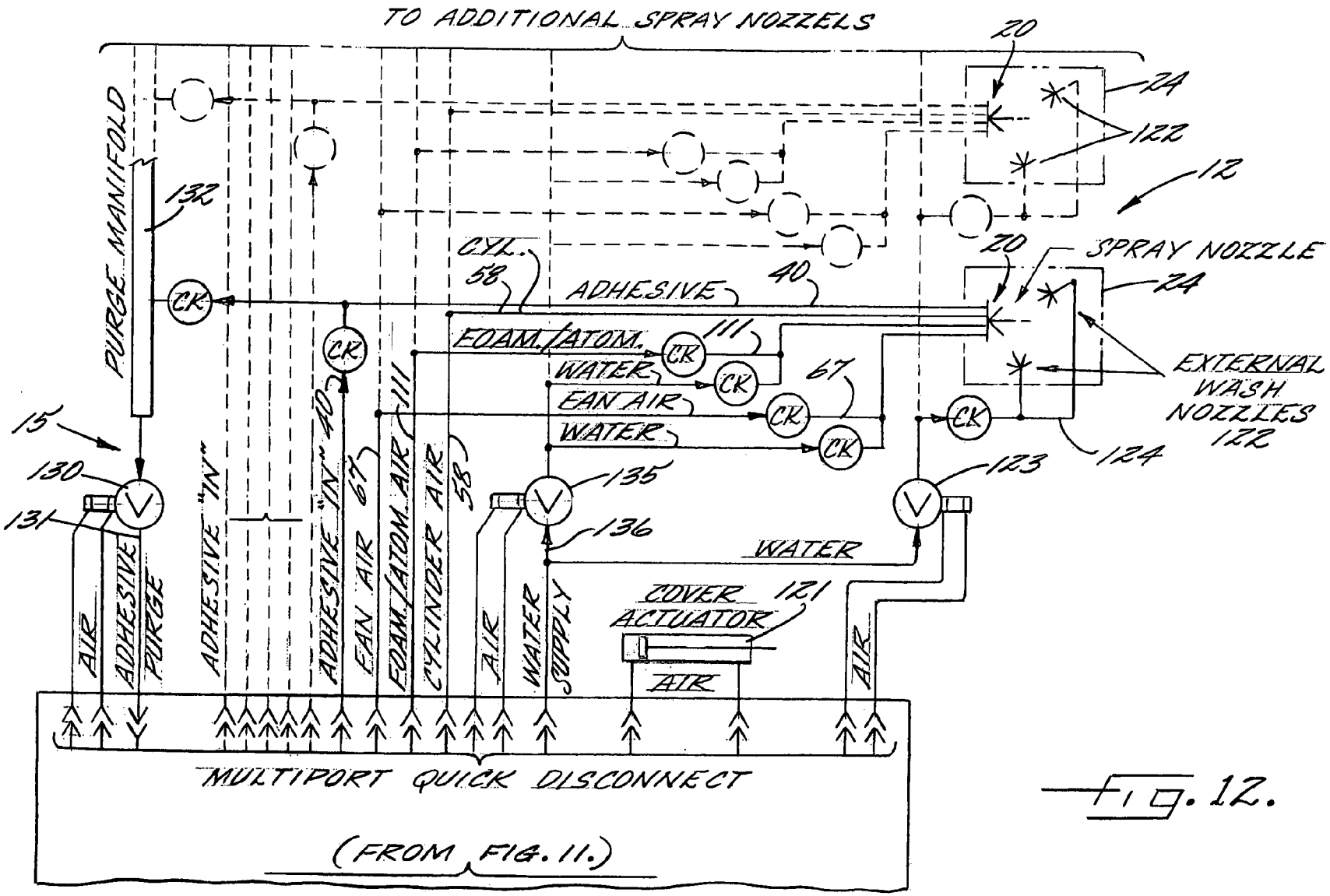

For cleaning external surfaces of the spray guns 20, the housing cover 120 serves as a header for two rows of water spray nozzles 122, which may be conventional full cone spray nozzles, with pairs of the nozzles 122 being located adjacent the ends of respective of the spray guns 20 when the cover 120 is closed. Through actuation of an air operated flow valve 123, water can be directed to a water manifold line 124, which in turn communicates with the exterior water spray nozzles 122 (FIGS. 3 and 12). Check valves, designated CK in FIG. 12, are provided in the inlet water supply lines to prevent back flow and dripping.

For effecting internal cleaning of the spray guns, again either manually or through automatic programming of the controller 100, an adhesive supply line control valve 126 is first closed and an adhesive purge valve 128 is opened to permit purging of liquid adhesive remaining in the liquid supply lines. Actuation of the control valve 130 to a purge line 131 permits communication of the purging water from the liquid adhesive manifold 132 and liquid passageways of the respective spray guns 20. In addition, actuation of control valves 135 effects the transmission of a water supply from line 136 through the foaming/atomizing air and fan air lines 111, 67 respectively, for cleaning the foaming/atomizing air and fan air passageways of the spray guns 20. Check valves, again designated "CK" in FIGS. 5 and 12, are provided for preventing air from entering the water supply lines and water from entering the air supply lines.

During a cleaning cycle purge water is collected within the housing 24, which preferably has sufficient pitch to allow gravity to carry the purge water to a discharge drain 129 (FIG. 3). For preventing the escape of purge water during a cleaning cycle, the cover 120 and main housing 24 have a dual wall construction to permit interfitting of inner and out panels 120*a*, 120*b* of the cover and inner and outer panels 24*a*, 24*b*, of the housing for preventing of the escape of the purge water without the necessity for resilient seals or precision interengagement of the cover and housing.

Figure 13:
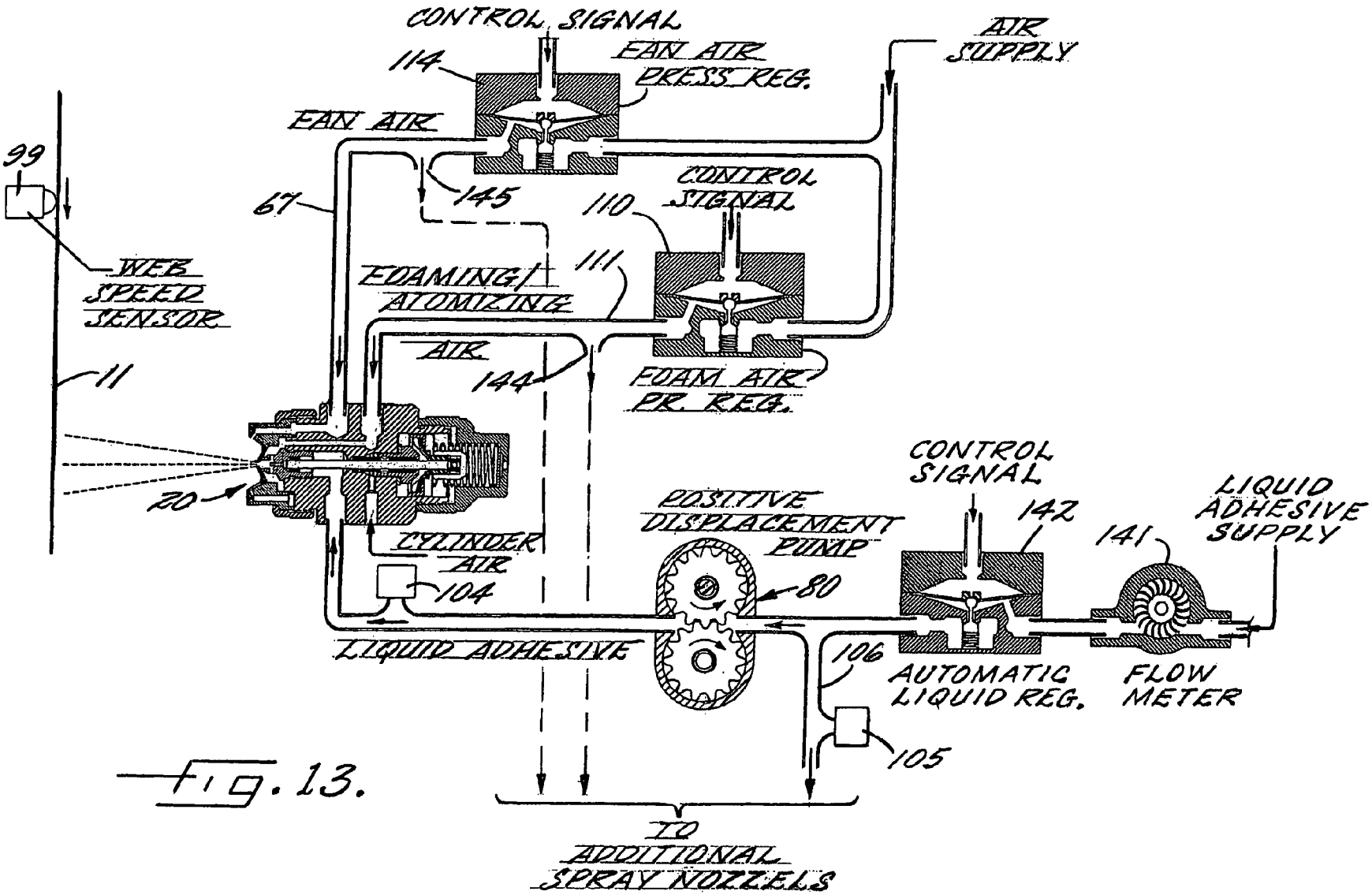
FIG. 13 is a diagrammatic depiction of an alternative embodiment of a liquid adhesive control system for the illustrated dispensing system.

Referring now to FIG. 13, there is shown an alternative liquid supply control systems that may be used in connection with the liquid adhesive delivery system of the present invention, wherein liquid flow is metered and compared with a theoretical value for compensating for and preventing liquid slippage through the positive displacement pumps. Again, items similar to those described above have been similar reference numerals. In this case, liquid adhesive is delivered under pressure to an inlet port 140 of a flow meter 141. Web speed is detected by a tachometer 99 and the positive displacement pump 80 is operated by the controller 100 at a speed to provide the necessary adhesive delivery rate to the spray gun 20. Pressure transmitters 104, 105 detect the pressure differential across the pump 80 and control the inlet pressure to the pump 80 by an automatic liquid regulator 142 to control and minimize liquid slippage at the pump 80. The actual liquid flow rate, as measured by the flow meter 141, is compared by the controller 100 to a theoretical flow rate and the speed of the pump 80 is adjusted to compensate for any differences between the theoretical flow rate and actual flow rate. The automatic air pressure regulators 110, 114 again control foaming/atomizing and fan air pressures to the spray gun 20. As described previously, individual pumps 80 supply adhesive to each additional spray gun 20 and foaming/atomizing and fan air ports 144, 145 respectively supply the additional spray guns. Air regulators are supplied by common air supply line and control signals from the regulators 110, 114 and 142 are supplied by current to pressure converters as described previously.

From the foregoing, it can be seen that the adhesive dispensing system of the present invention is adapted for more uniformly applying liquid adhesives onto moving substrates, notwithstanding changes in line speed, adhesive liquid flow rates, or air atomizing pressures. The liquid dispensing system is effective for generating and applying a water based liquid adhesive foam in a manner that augments adhesive bonds of the laminated plies, facilitates faster drying, and minimizing damaging bleed through of the substrate. The liquid adhesive dispensing system is relatively economical in construction and is adapted for efficient automated control. The system further includes an automatically operable cleaning system for easy maintenance.

What is claimed is:

1. A liquid adhesive dispensing system for dispensing liquid adhesive onto a moving substrate comprising a header having at least one spray gun, a liquid adhesive supply, a pressurized air supply, said spray gun having a liquid inlet coupled to said liquid adhesive supply for receiving liquid adhesive from said liquid adhesive supply and a spray nozzle for dispensing liquid adhesive from said spray gun onto the moving substrate, said spray gun having an foaming/atomizing air inlet coupled to said pressurized air supply for receiving pressurized air and directing pressurized air to said nozzle, a selectively operable variable speed positive displacement pump coupled between said liquid adhesive supply and said spray gun for directing a metered quantity of liquid adhesive to said spray gun proportional to the rate of movement of the substrate, and said nozzle having a body formed with a liquid adhesive flow passage communicating with said liquid adhesive inlet, said nozzle having a nose portion extending from a downstream end of said nozzle body which defines a liquid adhesive discharge orifice, an air cap mounted in surrounding relation to said nozzle and having a central discharge orifice coaxially aligned with said nozzle nose portion and at least partially surrounding to said nozzle nose portion for defining a foaming/atomizing air passageway communicating with said pressurized air supply for directing pressurized air in surrounding relation to liquid adhesive discharging from said nose portion discharge orifice for atomizing the liquid adhesive into a foam of fine bubbles for dispensing into said moving substrate.

2. The liquid dispensing system of claim 1 including a sensor for sensing the rate of movement of said substrate, and a control operable for controlling the operating speed of said positive displacement pump in relation to the sensed rate of movement of said substrate.

3. The liquid dispensing system of claim 2 in which said header includes a plurality of said spray guns, said spray guns each having a liquid supply line with a respective positive displacement pump for directing a metered quantity of liquid adhesive to the respective spray gun proportional to the rate of substrate movement.

4. The liquid dispensing system of claim 2 in which said pressurized air supply to said foaming/atomizing air inlet of said spray gun includes a pressure regulator operable from said control for causing a predetermined pressurized air flow to be directed to the spray gun.

5. The liquid dispensing system of claim 4 in which said control is operable for controlling the pressure of air supplied to said spray gun in relation to the operating speed of said positive displacement pump.

6. The liquid adhesive dispensing system of claim 1 in which said positive displacement pump has a liquid supply line coupled to said liquid adhesive supply and an outlet line coupled to said spray gun, a first sensor for sensing the liquid pressure in said outlet line, a second sensor for sensing the liquid pressure in said inlet line, and a control operable in response to said sensors sensing a differential in the liquid pressure in said inlet and outlet lines for adjusting the pressure of liquid adhesive supplied to said inlet line for equalizing the liquid pressures in said inlet and outlet lines.

7. The liquid dispensing system of claim 6 including a selectively operable pressure regulator for adjustably establishing the pressure of said liquid adhesive supply, and said control being operable in response to said first and second sensors sensing a pressure differential in said inlet and outlet lines for adjusting said pressure regulator and the pressure of said liquid supply for equalizing the liquid pressures in said inlet and outlet lines.

8. The liquid dispensing system of claim 6 in which said liquid supply includes a pressure vessel containing a quantity of liquid adhesive, a selectively operable pressure regulator for controlling the pressure of said pressure vessel, and said control being operable in response to said first and second sensors sensing a pressure differential in said inlet and outlet lines for operating said pressure vessel regulator to adjust the pressure of said pressure vessel.

9. The liquid adhesive dispensing system of claim 1 in which said positive displacement pump is a gear pump having a liquid inlet and a liquid outlet, and said gear pump having a pair of intermeshing rotatable gears operable for directing a predetermined quantity of liquid through the pump during each revolution of said gears.

10. The liquid adhesive dispensing system of claim 1 in which said nose portion is disposed in recessed relation to a downstream end of said air cap discharge orifice for defining a mixing chamber within said air cap.

11. The liquid adhesive system of claim 10 in which said nozzle nose portion and said air cap discharge orifice have sharp annular corners which define a passageway for communicating foaming/atomizing air to said mixing chamber.

12. The liquid adhesive dispensing system of claim 11 in which said cover is pivotably movable between said open and closed positions.

13. The liquid adhesive dispensing system of claim 12 in which said housing includes a lower open top compartment and said cover is pivotable relative to said lower compartment between open and closed positions, said cover and lower compartment each having a double walled construction, and said cover being movable to said closed position with the walls of said compartment and cover being in interengaging relation to prevent the escape of cleaning and purge water from the housing without a separate sealing member.

14. The liquid dispensing system of claim 13 in which said pressurized air supply to said spray gun includes a pressure regulator operable from said control for causing a predetermined pressurized air flow to be directed to each of said spray guns.

15. The liquid adhesive dispensing system of claim 13 in which each said positive displacement pump is a gear pump having a liquid inlet and a liquid outlet, and each said gear pump having a pair of intermeshing rotatable gears operable for directing a predetermined quantity of liquid through the pump during each revolution of said gears.

16. The liquid adhesive dispensing system of claim 13 in which pressurized air is directed to said foaming/atomizing air inlets of said spray guns from a common manifold line, and said control includes a pressure regulator in said manifold line for controlling the pressure of the foaming/atomizing air.

17. The liquid dispensing system of claim 12 in which said header includes a plurality of said spray guns, spray guns each having a liquid supply line with a respective positive displacement pump for directing a metered quantity of liquid adhesive to the respective spray gun.

18. The liquid adhesive dispensing system of claim 1 including a water supply selectively connectable to said spray gun for directing a purge water through said spray gun for cleaning internal passages of said spray gun during a cleaning cycle, and said header including a housing for collecting purge water directed through said spray gun.

19. The liquid adhesive dispensing system of claim 18 in which said housing includes a selectively closable cover, and said cover carrying at least one water spray nozzle connectable to said water supply for directing water onto and cleaning exterior surfaces of said spray gun.

20. The liquid adhesive dispensing system of claim 19 in which said cover is selectively movable between an open position which permits direction of liquid adhesive from said spray gun onto the moving substrate and a closed position in which said cover closes the housing and orients the water spray nozzle in a direction toward the spray gun.

21. The liquid adhesive dispensing system of claim 20 in which said housing has a drain for draining purge and cleaning water from said housing.

22. The liquid dispensing system of claim 1 in which said liquid adhesive supply is a supply of a water based liquid adhesive.

23. The liquid dispensing system of claim 1 including a control for controlling the operating speed of said positive displacement pump, a liquid flow meter for measuring the liquid flow rate to said pump from said liquid supply, said control being operable for comparing the measured liquid flow rate with a theoretical flow rate and adjusting the speed of said positive displacement pump to compensate for differences between the theoretical flow rate and the actual flow rate.

24. The liquid adhesive dispensing system of claim 1 in which said nozzle has a relatively larger diameter upstream body portion formed with a relatively large diameter adhesive liquid flow passage section, and said smaller diameter nose portion is formed with a nozzling passage section smaller in diameter than said upstream passage section.

25. The liquid adhesive dispensing system of claim 1 in which said air cap includes a pair of fan air discharge orifices communicating with a pressurized air source for directing air streams onto opposite sides of the discharging atomized liquid adhesive foam for directing the foam in a flattened pattern for dispensing onto said moving substrate.

26. A liquid dispensing system for dispensing liquid onto a moving substrate comprising:

a header having a plurality of liquid spray guns, a liquid supply, a pressurized air supply, said spray guns each having a liquid inlet coupled to said liquid supply for receiving liquid from said liquid supply and a spray nozzle for dispensing liquid from said spray gun onto the moving substrate, said spray guns each having an atomizing air inlet coupled to said pressurized air supply for receiving pressurized air and directing pressurized air to said nozzle for atomizing liquid directed from the spray gun, at least one selectively operable variable speed positive displacement pump coupled between the liquid supply and the spray guns for directing a metered quantity of liquid to the spray guns, said spray guns each including a nozzle body having a liquid flow passage communicating with said liquid inlet, said nozzle liquid flow passage including a relatively small diameter nozzling section and a downstream larger diameter mixing chamber, and said spray guns each having an air atomizing air passage communicating between said atomizing air inlet and said nozzle mixing chamber such that pressurized air directed to said mixing chamber intermixes, atomizes, and creates a fine bubble foam of liquid adhesive prior to discharge from said nozzle and dispensing onto said moving substrate, and a control operable for controlling the operating speed of said at least one positive displacement pump in relation to the rate of movement of said substrate such that a substantially uniform foam is generated and dispensed by said spray guns regardless of the operating speed of the at least one positive displacement pump within an operating range.

27. The liquid dispensing system of claim 26 in which said spray gun includes an air cap mounted in surrounding relation to a discharge end of said nozzle, said nozzle and air cap defining a pressurized air chamber communicating with said atomizing air inlet, said nozzle mixing chamber including an outwardly tapered air interaction section communicating with said nozzling passage section and a downstream cylindrical expansion section communicating with said air interaction section, and said nozzle having a plurality of circumferentially spaced air inlet passages communicating with a tapered side wall of said air interaction passage section for directing a plurality of pressurized air streams into said air interaction section in transverse relation to liquid adhesive discharging from said nozzling section.

28. The liquid dispensing system of claim 26 including a respective positive displacement pump for each said spray gun, and a single selectively operable drive motor for operating the positive displacement pumps for each of the spray guns.

29. The liquid dispensing system of claim 28 in which said drive motor is operable for simultaneously operating the positive displacement pumps of each of said spray guns at a common operating speed.

30. The liquid dispensing system of claim 28 in which said drive motor has a first drive chain for driving the positive displacement pumps of some of said spray guns, and a second drive train for driving the positive displacement pumps of other of said spray guns.

31. The liquid dispensing system of claim 29 in which said positive displacement pumps for each of said spray guns are mounted on a common frame, and said drive motor has an output shaft with a first drive element for driving said first drive train and a second drive element for driving said second drive train.

32. The liquid dispensing system of claim 26 including a sensor for sensing the rate of movement of said substrate.

33. The liquid dispensing system of claim 32 in which said control is operable for controlling the pressure of air supplied to said spray guns in relation to the operating speeds of said positive displacement pumps.

34. The liquid adhesive dispensing system of claim 26 in which said at least one said positive displacement pump has a liquid supply line coupled to said liquid supply and an outlet line coupled to said spray gun, a first sensor for sensing the liquid pressure in said outlet line, a second sensor for sensing the liquid pressure in said inlet line, and said control being operable in response to said sensors sensing a differential in the liquid pressure in said inlet and outlet lines for adjusting the pressure of liquid supplied to said inlet line for equalizing the liquid pressures in said inlet and outlet lines.

35. The liquid dispensing system of claim 34 including a selectively operable pressure regulator for adjustably establishing the pressure of said liquid adhesive supply, and said control being operable in response to said first and second sensors sensing a pressure differential in said inlet and outlet lines for adjusting said pressure regulator and the pressure of said liquid supply for equalizing the liquid pressures in said inlet and outlet lines.

36. The liquid adhesive dispensing system of claim 26 in which said at least one positive displacement pump is a gear pump having a liquid inlet and a liquid outlet, and said gear pump having a pair of intermeshing rotatable gears operable for directing a predetermined quantity of liquid through the pump during each revolution of said gears.

37. A liquid adhesive dispensing system for dispensing liquid adhesive onto a moving substrate comprising a header having at least one spray gun, a liquid adhesive supply, a pressurized air supply, said spray gun having a liquid inlet coupled to said liquid adhesive supply for receiving liquid adhesive from said liquid adhesive supply and a spray nozzle for dispensing liquid adhesive from said spray gun onto the moving substrate, said spray gun having a foaming/atomizing air inlet coupled to said pressurized air supply for receiving pressurized air and directing pressurized air to said spray nozzle, a selectively operable variable speed positive displacement pump coupled between said liquid adhesive supply and said spray gun for directing a metered quantity of liquid adhesive to said spray gun;

said nozzle having a liquid adhesive flow passage communicating with said liquid adhesive inlet, said nozzle liquid adhesive flow passage including a relatively small diameter nozzling section for accelerating the flow of liquid adhesive through the nozzle prior to discharge from a discharge orifice thereof, an air cap mounted in surrounding relation to said nozzle and defining an air passageway communicating with said pressurized air supply for receiving pressurized air and directing pressurized air into intermixing relation with liquid adhesive directed from said nozzle discharge orifice for intermixing, atomizing, and creating a fine bubble foam for dispensing onto said moving substrate; and a control for controlling the operating speed of said positive displacement pump for directing liquid adhesive to said spray gun proportional to the speed of the moving substrate, and said control being operable for controlling the pressure of atomizing air supplied to said spray gun in relation to the operating speed of said positive displacement pump such that a substantially uniform foam is generated by said spray gun regardless of the operating speed of the pump within an operating range.

38. The liquid adhesive dispensing system of claim 37 in which said air cap and nozzle define a mixing chamber into which pressurized liquid adhesive and air is directed for intermixing, atomizing, and creating a fine bubble foam prior to discharge from the spray gun.

* * * * *